US008956210B2

(12) United States Patent
Chun

(10) Patent No.: US 8,956,210 B2
(45) Date of Patent: Feb. 17, 2015

(54) METHODS AND SYSTEMS FOR PLAYING BACCARAT JACKPOT

(75) Inventor: Jay Chun, Hong Kong (CN)

(73) Assignee: Solution Champion Limited

( * ) Notice: Subject to any disclaimer, the term of this patent is extended or adjusted under 35 U.S.C. 154(b) by 1002 days.

(21) Appl. No.: 12/984,558

(22) Filed: Jan. 4, 2011

(65) Prior Publication Data

US 2011/0105207 A1 May 5, 2011

Related U.S. Application Data

(63) Continuation of application No. 11/042,732, filed on Jan. 24, 2005, now Pat. No. 7,918,723.

(51) Int. Cl.

| | |
|---|---|
| ***A63F 13/00*** | (2014.01) |
| ***A63F 1/04*** | (2006.01) |
| ***A63F 1/12*** | (2006.01) |
| ***A63F 1/14*** | (2006.01) |
| ***G07F 17/32*** | (2006.01) |
| *A63F 1/00* | (2006.01) |
| *A63F 3/00* | (2006.01) |

(52) U.S. Cl.

CPC ..... *G07F 17/3258* (2013.01); *G07F 17/3244* (2013.01); *G07F 17/3293* (2013.01); *A63F 1/00* (2013.01); *A63F 2001/001* (2013.01); *A63F 2001/008* (2013.01); *A63F 3/00157* (2013.01); *G07F 17/32* (2013.01); *G07F 17/3288* (2013.01)

USPC ..... 463/12; 463/10; 463/11; 463/13; 463/26; 463/27; 463/28; 273/149 R; 273/292

(58) Field of Classification Search

CPC ..... A63F 1/00; A63F 2001/001; A63F 2001/008; A63F 3/00157; G07F 17/32; G07F 17/3288; G07F 17/3293; G07F 17/3258; G07F 17/3244

USPC ..... 463/10–13, 26–28; 273/149 R, 292

See application file for complete search history.

(56) References Cited

U.S. PATENT DOCUMENTS

| | | | |
|---|---|---|---|
| 3,810,627 | A | 5/1974 | Levy |
| 3,909,002 | A | 9/1975 | Levy |

(Continued)

FOREIGN PATENT DOCUMENTS

| | | |
|---|---|---|
| CA | 2377577 | 6/2000 |
| EP | 1101513 | 5/2001 |

(Continued)

OTHER PUBLICATIONS

International Search Report for PCT/CA2006/002069 mailed Mar. 20, 2007, 16 pages.

(Continued)

*Primary Examiner* — William H McCulloch, Jr.

(74) *Attorney, Agent, or Firm* — Jennifer Meredith, Esq.; Meredith & Keyhani, PLLC

(57) ABSTRACT

A method and system for playing jackpot and live baccarat games are provided. One feature of the jackpot method involves the use of card combinations that includes at least one zero-point card. Another feature of the jackpot method involves initial jackpot contribution from the banker who operates the baccarat game. It is also provided a software program or a set of software program for carrying out any or all the steps of the disclosed gaming method.

20 Claims, 4 Drawing Sheets

(56) References Cited

U.S. PATENT DOCUMENTS 4,339,798 A 7/1982 Hedges
4,467,424 A 8/1984 Hedges
4,659,082 A 4/1987 Greenberg
4,861,041 A 8/1989 Jones
4,926,327 A 5/1990 Sidley
5,033,744 A 7/1991 Bridgeman
5,042,818 A 8/1991 Weingardt
5,048,833 A 9/1991 Lamie
5,362,064 A 11/1994 Lofink
5,393,067 A 2/1995 Paulsen
5,395,119 A 3/1995 Jacob
5,395,120 A 3/1995 Malek
5,476,259 A 12/1995 Weingardt
5,605,334 A 2/1997 McCrea
5,639,092 A 6/1997 Macaisa
5,669,606 A 9/1997 Brown
5,673,917 A 10/1997 Vancura
5,707,287 A 1/1998 McCrea
5,735,525 A 4/1998 McCrea
5,762,552 A 6/1998 Vuong
5,770,533 A 6/1998 Franchi
5,779,546 A 7/1998 Meissner
5,788,574 A 8/1998 Ornstein
5,795,225 A 8/1998 Jones
5,800,268 A 9/1998 Molnick
5,806,854 A 9/1998 Coleman
5,830,067 A 11/1998 Graves
5,836,818 A 11/1998 Jones
5,842,698 A 12/1998 Brown
5,876,283 A 3/1999 Parra
5,909,876 A 6/1999 Brown
5,911,626 A 6/1999 McCrea
5,921,865 A 7/1999 Scagnelli
5,957,459 A 9/1999 Chae
5,961,119 A 10/1999 Brown
6,001,016 A 12/1999 Walker
6,019,374 A 2/2000 Breeding
6,093,103 A 7/2000 McCrea
6,117,012 A 9/2000 McCrea
6,146,270 A 11/2000 Huard
6,159,095 A 12/2000 Frohm
6,217,447 B1 4/2001 Lofink
6,279,910 B1 8/2001 deKeller
6,293,864 B1 9/2001 Romero
6,345,824 B1 2/2002 Selitzky
6,346,044 B1 2/2002 Mccrea
6,361,437 B1 3/2002 Walker
6,409,602 B1 6/2002 Wiltshire
6,460,848 B1 10/2002 Soltys
6,508,709 B1 1/2003 Karmarkar
6,511,072 B1 1/2003 Santa Cruz
6,517,436 B2 2/2003 Soltys
6,540,230 B1 4/2003 Walker
6,569,018 B2 5/2003 Jaffe
6,575,834 B1 6/2003 Lindo
6,582,301 B2 6/2003 Hill
6,588,758 B1 7/2003 Lee
6,628,244 B1 9/2003 Hirosawa
6,659,866 B2 * 12/2003 Frost et al. ..... 463/17
6,712,696 B2 3/2004 Soltys
6,719,291 B1 4/2004 deKeller
6,726,564 B2 4/2004 Hogan
6,755,741 B1 * 6/2004 Rafaeli ..... 463/25
6,800,026 B2 10/2004 Cannon
6,837,494 B2 * 1/2005 Lee ..... 273/292
6,916,245 B1 * 7/2005 Vancura et al. ..... 463/26
7,008,319 B2 3/2006 Parham
7,070,505 B2 * 7/2006 Vancura et al. ..... 463/25
7,114,724 B2 10/2006 Ritzer
7,189,161 B1 3/2007 Wiltshire
7,198,272 B2 4/2007 Duhamel
7,213,812 B2 * 5/2007 Schubert et al. ..... 273/149 R
7,264,241 B2 * 9/2007 Schubert et al. ..... 273/149 R
7,303,475 B2 12/2007 Britt
7,309,065 B2 * 12/2007 Yoseloff et al. ..... 273/292
7,325,806 B1 * 2/2008 Feola ..... 273/292
7,367,884 B2 5/2008 Breeding
7,404,765 B2 7/2008 Soltys
7,407,438 B2 8/2008 Schubert
7,419,160 B1 9/2008 D'Ambrosio
7,434,805 B2 10/2008 Grauzer
7,451,987 B1 11/2008 Feola
7,591,728 B2 9/2009 Gioia
7,621,533 B2 11/2009 Kenny
7,731,586 B2 6/2010 Letovsky
7,735,657 B2 6/2010 Johnson
7,753,798 B2 7/2010 Soltys
7,762,889 B2 7/2010 Shijeta
7,769,232 B2 8/2010 Downs
7,775,868 B2 * 8/2010 Toyoda ..... 463/12
7,780,515 B2 8/2010 Okada
7,909,688 B2 * 3/2011 Yoshizawa ..... 463/13
7,914,368 B2 3/2011 Chun
7,918,723 B2 4/2011 Chun
7,922,587 B2 4/2011 Chun
8,002,281 B2 * 8/2011 Kearns, Sr. ..... 273/292
8,087,985 B2 * 1/2012 Katz ..... 463/12
8,152,617 B2 * 4/2012 Katz ..... 463/13
8,182,321 B2 * 5/2012 Chun ..... 463/12
8,308,559 B2 * 11/2012 Chun ..... 463/31
8,323,105 B2 * 12/2012 Chun ..... 463/31
2001/0000118 A1 4/2001 Sines et al.
2001/0029200 A1 10/2001 Romero
2002/0002070 A1 1/2002 Romero
2002/0002073 A1 1/2002 Montgomery
2002/0015489 A1 2/2002 Ben-David
2002/0068635 A1 6/2002 Hill
2002/0072407 A1 6/2002 Soltys
2002/0090988 A1 * 7/2002 Frost et al. ..... 463/17
2002/0094869 A1 7/2002 Harkham
2002/0111205 A1 8/2002 Beavers
2002/0115489 A1 8/2002 Jordan
2002/0147042 A1 10/2002 Vuong et al.
2002/0147047 A1 10/2002 Letovsky
2003/0003997 A1 1/2003 Vuong
2003/0013510 A1 1/2003 Vuong
2003/0050107 A1 3/2003 Moody
2003/0064781 A1 4/2003 Muir
2003/0067112 A1 * 4/2003 Grauzer et al. ..... 273/149 R
2003/0069071 A1 4/2003 Britt
2003/0104854 A1 6/2003 Cannon
2003/0151199 A1 8/2003 Lee
2003/0151201 A1 8/2003 Lee
2003/0232651 A1 12/2003 Huard
2004/0023712 A1 2/2004 Oliver
2004/0023722 A1 2/2004 Vuong
2004/0087357 A1 5/2004 Johnson
2004/0108656 A1 6/2004 Snow
2004/0116177 A1 * 6/2004 Frost et al. ..... 463/17
2004/0116179 A1 6/2004 Nicely
2004/0224777 A1 11/2004 Smith
2004/0235542 A1 11/2004 Stronach
2005/0062227 A1 3/2005 Grauzer
2005/0073102 A1 4/2005 Yoseloff
2005/0218597 A1 10/2005 Parsadaian
2005/0233794 A1 10/2005 Cannon
2006/0052168 A1 3/2006 Shacham
2006/0063577 A1 3/2006 Downs
2006/0071429 A1 4/2006 Okujyo
2006/0103071 A1 5/2006 Ritzer
2006/0128472 A1 6/2006 Beavers
2006/0148547 A1 7/2006 Montgomery
2006/0166726 A1 7/2006 Chun
2006/0178181 A1 8/2006 Chun
2006/0226605 A1 10/2006 Kenny
2006/0287042 A1 12/2006 Osawa
2006/0287058 A1 12/2006 Resnick
2007/0026922 A1 2/2007 Lindo
2007/0026947 A1 2/2007 Chun
2007/0032283 A1 2/2007 Chun
2007/0060259 A1 3/2007 Pececnik
2007/0135204 A1 6/2007 Nicely
2007/0155512 A1 7/2007 Wells
2007/0218968 A1 9/2007 Snow

(56) References Cited

U.S. PATENT DOCUMENTS

| | | | |
|---|---|---|---|
| 2007/0243927 | A1 | 10/2007 | Soltys |
| 2007/0243929 | A1 | 10/2007 | Skotarczak |
| 2007/0243935 | A1 | 10/2007 | Huizinga |
| 2008/0009334 | A1 | 1/2008 | Walker |
| 2008/0026807 | A1 | 1/2008 | Moshal |
| 2008/0076499 | A1 | 3/2008 | Lowery |
| 2008/0085769 | A1 | 4/2008 | Lutnick |
| 2008/0108400 | A1 | 5/2008 | Chun |
| 2008/0113778 | A1 | 5/2008 | Chun |
| 2008/0113783 | A1 | 5/2008 | Czyzewski |
| 2008/0146311 | A1 | 6/2008 | Walker |
| 2008/0194334 | A1 | 8/2008 | Kuok |
| 2008/0230993 | A1 | 9/2008 | Chun |
| 2008/0254881 | A1 | 10/2008 | Lutnick |
| 2008/0280667 | A1 | 11/2008 | Chun |
| 2008/0280668 | A1 | 11/2008 | Chun |
| 2008/0305855 | A1 | 12/2008 | Czyewski |
| 2009/0029755 | A1 | 1/2009 | Chun |
| 2009/0061974 | A1 | 3/2009 | Lutnick |
| 2009/0069079 | A1 | 3/2009 | Britt |
| 2009/0115133 | A1 | 5/2009 | Kelly |
| 2009/0176547 | A1 | 7/2009 | Katz |
| 2009/0221360 | A1 | 9/2009 | Wooding |
| 2010/0102511 | A1 | 4/2010 | Tammesoo |
| 2010/0105457 | A1 | 4/2010 | Miller |
| 2010/0105459 | A1 | 4/2010 | Miller |
| 2010/0113119 | A1 | 5/2010 | Miller |
| 2010/0117299 | A1 | 5/2010 | Nicely |
| 2010/0222133 | A1 | 9/2010 | Spencer |
| 2010/0255897 | A1 | 10/2010 | Pececnik |
| 2010/0295247 | A1 | 11/2010 | Laduca |
| 2011/0031694 | A1 | 2/2011 | Cohen |
| 2011/0039612 | A1 | 2/2011 | Pececnik |
| 2011/0105207 | A1 | 5/2011 | Chun |
| 2011/0140362 | A1 | 6/2011 | Chun |
| 2011/0159965 | A1 | 6/2011 | Chun |
| 2014/0135088 | A1* | 5/2014 | Chun ..... 463/11 |

FOREIGN PATENT DOCUMENTS

| | | |
|---|---|---|
| EP | 467329 | 10/2004 |
| EP | 1892683 | 2/2008 |
| GB | 2408696 | 6/2005 |
| GB | 2430385 | 3/2007 |
| WO | 0079467 | 12/2000 |
| WO | 0217841 | 3/2002 |
| WO | 2005056134 | 6/2005 |
| WO | 2007016035 | 2/2007 |
| WO | 2008026950 | 3/2008 |
| WO | 2008092385 | 8/2008 |
| WO | 2009107131 | 9/2009 |

OTHER PUBLICATIONS

International Search Report for PCT/CA2006/001295, mailed Nov. 20, 2006, 17 pages.

EZ Baccarat, DP Stud, Inc., www.ezbaccarat.com, 2 pages, (2003).

* cited by examiner

FIGURE 3A
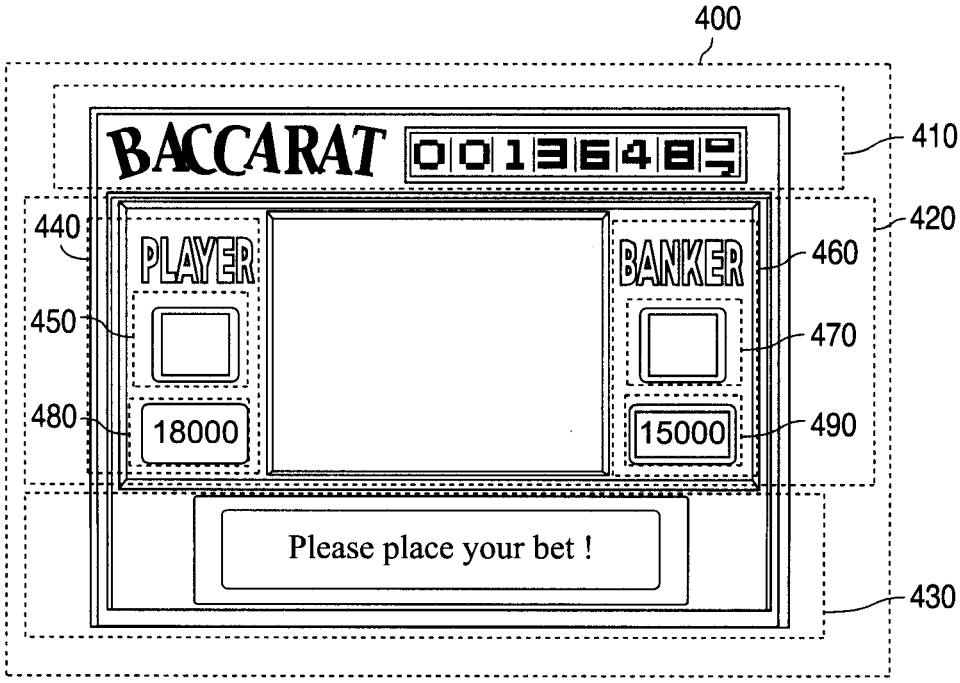
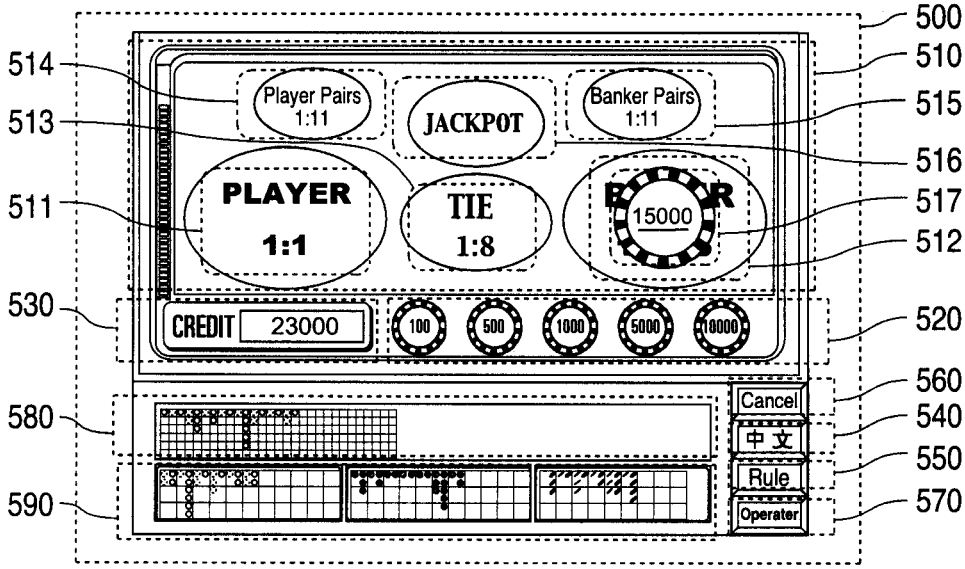
FIGURE 3B

METHODS AND SYSTEMS FOR PLAYING BACCARAT JACKPOT

CROSS-REFERENCE TO RELATED APPLICATIONS

The present application is a continuation of, and claims priority to and the benefit of the U.S. patent application Ser. No. 11/042,732, filed in the United States Patent and Trademark Office on Jan. 24, 2005 now U.S. Pat. No. 7,918,723 and titled "Methods and systems for playing baccarat jackpot," the entire content of which is incorporated by this reference.

BACKGROUND OF THE INVENTION

The present invention is generally directed to a method of play and apparatus for playing a live baccarat game. In particular, the present invention relates to a method for playing a live baccarat game and playing jackpot.

Baccarat is one of the more popular gambling games played in casinos or gaming establishments. As is well known, the game is played on an elongated table having a game board displayed along the upper surface of the table. The game board displays certain wagering areas, and the elongated table allows for the seating of multiple players or bettors (1-16) and the positioning of the multiple dealers (3) necessary for operating the casino game. Bettor locations are typically numbered on the table and each bettor location has an area designated for a wager on the bank hand and an area designated for a wager on the player hand. Baccarat uses a standard deck of 52 playing cards and is usually dealt from a shoe having multiple decks that have been shuffled together prior to the beginning of play.

A feature of conventional baccarat games is that they have relatively simple rules. However, the simplicity of the rules has led to a corresponding simplicity in the relatively few types of wagers which may be placed during the play of the game, which may limit interest on the part of the player(s) and thus further limit the casino in terms of profit and payout.

The embodiments described below address the above-described issues and needs.

SUMMARY OF THE INVENTION

Provided herein are methods and systems therefore for playing a modified live baccarat game. The methods allow the wagering on the live-baccarat games according to conventional rules. In addition, the methods provided herein allow betting on a site bet or wager for jackpot. Outcomes of the jackpot betting can be determined by combinations of cards that involve at least one zero-point card, described below. The present invention also provides a jackpot gaming method that allows the banker to make initial contributions for the jackpot game.

The method for playing live baccarat described herein includes the following steps:

dealing cards to a player hand and a bank hand according to a set of conventional baccarat rules, allowing at least a first player to place a bet on live baccarat, allowing at least a second player to place a bet on jackpot where the second player can be the same as or different from the first player, determining the outcome of the live baccarat game according to the set of conventional baccarat rules, and determining the outcome of the jackpot according to a combination of cards that comprises at least one zero-point cards.

The present invention also discloses a software program or a set of software programs for carrying out any or all steps of the betting method described herein. The live baccarat game can also be incorporated into an electronic device or an entertainment gaming machine.

BRIEF DESCRIPTION OF DRAWINGS

FIGS. 3A, 3B, 4A and 4B show the detailed layout of the betting terminal of a baccarat machine.

DETAILED DESCRIPTION

Figure 1:
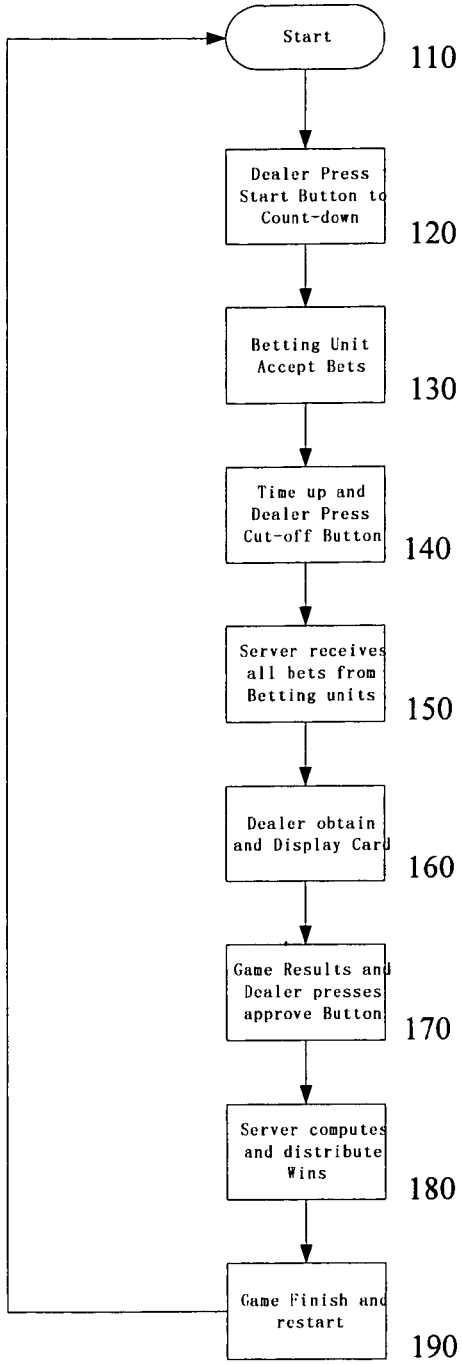
FIG. 1 is a flow chart disclosing the incorporation of the present betting methods in the game of baccarat.

Provided herein are methods and systems therefore for playing a modified live baccarat game. The methods allow the wagering on the live baccarat games according to conventional rules. In addition, the methods provided herein allow betting on a site bet or wager for jackpot. Outcomes of the jackpot betting can be determined by combinations of cards that involve at least one zero-point card, described below. The present invention also provides a jackpot gaming method that allows the banker to make initial contributions for the jackpot game. As used herein, a zero-point card refers to any of the 10, J, Q, or K, and the banker refers to one who owns or operates the live baccarat establishment.

In general, the method for playing live baccarat described herein includes the following steps:

dealing cards to a player hand and a bank hand according to a set of conventional baccarat rules, allowing at least a first player to place a bet on live baccarat, allowing at least a second player to place a bet on jackpot where the second player can be the same as or different from the first player, determining the outcome of the live baccarat game according to the set of conventional baccarat rules, and determining the outcome of the jackpot according to a combination of cards that comprises at least one zero-point cards.

The present invention also provides a software program or a set of software programs for carrying out any or all steps of the betting method described herein. The baccarat game can also be incorporated into an electronic device or an entertainment gaming machine. Representative electronic devices include, but are not limited to, laptop computers or desktop computers.

Live Baccarat Game

The object of baccarat is for the bettor to successfully wager on whether the bank's hand or the player's hand is going to win. The bettor receives even money for his wager if he selects the winning hand and loses his wager if he selects the losing hand. Because of the rules of play of baccarat, the bank's hand has a slightly higher chance of winning than does the player's hand. Therefore, if the bettor wagers on the bank's hand, the bettor is required to pay to the gaming establishment a commission (typically 5%) of the amount the bettor wins. No commission is paid if the bettor successfully wagers on the player's hand.

The term "wager", as used herein, can be used interchangeably with the term "bet." The term "wagering" is used interchangeably with the term "betting."

Conventional methods of playing baccarat are described as follows:

A multiple number of decks of standard playing cards, 52 in number, are used; typically six to twelve decks are shuffled together and placed in a shoe from which the cards are dealt during the play of the game.

Each bettor makes a wager on whether the bank's hand or the player's hand will win. After all wagers are made, two cards are dealt from the shoe to the bank position and two cards are dealt from the shoe to the player's position on the table layout. The cards are turned face up and the value of the bank hand and the player hand is determined.

Aces count as one; kings, queens, jacks and tens count as zero and the other cards count as their respective face value. The suits (hearts, diamonds, spades and clubs) have no meaning in baccarat. The highest hand value in baccarat is nine. All hand values range from a low of zero to a high of nine. If when the cards are added together, the total of the hand exceeds nine, then the hand value is determined by subtracting ten from the total of the hand. For example, a seven and nine total sixteen, but the hand value is six. An Ace and a nine total ten, but the hand value is zero.

A two card total of eight or nine is called a "natural"; a two card total of zero is called a "baccarat". As will be explained hereafter, in certain situations in the play of the game, a third card will be dealt. The value of this third card is added to the total of the first two cards and a new hand value is established. Again, if the new hand total exceeds nine, the hand value is determined by subtracting ten from the total of the hand. Wagering locations are provided on the baccarat table layout. Whichever of the bank hand or the player hand is closest to a total of nine is the winner.

The way of betting may differ in different gaming establishments. In the U.S., for example, prior to the deal, each bettor can make one of three wagers: 1) that the bank hand will win, 2) that the player hand will win, or 3) that the bank hand and the player hand will tie. In Macau, for example, one can make one of five wagers: 1) that the bank hand will win, 2) that the player hand will win, 3) that the bank hand and the player hand will tie, 4) that the first two cards in the bank hand are of the same kind, regardless of the type of suit, forming a Bank Pair, or (5) that the first two cards in the player hand are of the same kind, regardless of the type of suit, forming a Player Pair.

All winning bank hand wagers in scenario 1) in both the U.S. and Macau are paid off at odds of one-to-one and the house charges a five percent (5%) commission on the amount won by the bettor. For example, if a bettor wagers $100 on the bank hand and the bank hand wins, the bettor wins $100 and is charged a $5 commission on the amount that the bettor won. The bettor is not charged any commission on the amount of his wager.

All wagers that select winning player hand in scenario 2) in both the U.S. and Macau are paid off at odds of one-to-one and the bettor is not charged any commission on the amount of his winnings or his wager.

All winning wagers on the tie in scenario 3) in both the U.S. and Macau can be paid off at odds of eight-to-one (depending on the gaming establishment) and the bettor is not charged any commission on the amount of his winnings or his wager. If a tie hand occurs, all wagers on the bank hand and all wagers on the player hand are "pushes" and the amount wagered is returned to the bettor.

All winning wagers on the Bank Pair bet in scenario 4) in Macau can be paid off at odds of eleven-to-one (depending on the gaming establishment) and the bettor is not charged any commission on the amount of his winnings or his wager.

All winning wagers on the Player Pair bet in scenario 5) in Macau can be paid off at odds of eight-to-one (depending on the gaming establishment) and the bettor is not charged any commission on the amount of his winnings or his wager.

The play of baccarat typically uses three casino dealers to operate the game. The casino dealers jointly participate in the shuffling of the decks of cards. After the shuffle is completed, one of the players is typically asked to cut the decks using a plastic cut card. The dealer then separates and restacks the cards from the point of the cut and the dealer or a player then inserts the plastic cut card no less than fifteen cards (in Las Vegas, U.S.) or no less than twelve cards (in Macau) from the ends of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of baccarat.

In conventional baccarat, the bettors deal the cards used in the game. Initially, one of the casino dealers (called the "caller") passes the shoe to the bettor sitting in seat number "1" at the baccarat table. After all wagers have been made, the caller tells the bettor with the shoe to begin the deal. The bettor deals a first card to the caller, a first card to himself, a second card to the caller and a second card to himself. All cards are dealt face down. The two cards given to the caller represent the player hand and the two cards kept by the bettor who is dealing the cards represent the bank hand.

The caller than allows one of the other bettors to turn up the player's hand. Traditionally, this honor is given to the bettor who has made the largest wager. The bettor turns up the two cards of the player's hand and tosses them to the caller. The caller places these two cards face up in the table location designated for the "player hand" and the caller announces the point total of the player hand.

The bettor who has the shoe then turns over the cards of the bank hand and tosses these two cards to the caller. The caller places these two cards face up in the table location designated for the "bank hand" and the caller announces to point total of the bank hand. Depending on the point total of the player's hand and the bank's hand, one more card may be dealt to either the player's hand, the bank's hand, or both. The rules for determining whether a third card is dealt are fixed rules, there is no discretion for either the player's hand or the bank's hand on whether a third card is dealt.

If either the player hand or the bank hand has a point total of eight or nine on the first two cards, no third card is dealt to either hand and the hand with the highest point total is the winner (or the hand is a tie, as the case may be). If neither the player hand or the bank hand has a point total of eight or nine, then there is a possibility of a third card draw.

The third card draw rules are as follows:

Rule #1: If the initial two card player hand has a point total of 0, 1, 2, 3, 4 or 5, draws a third card. If the initial two card player hand has a point total of 6 or 7, the player hand stands and does not receive a third card.

Rule #2: If the player hand stands and does not draw a third card, then the bank hand follows Rule #1. In other words, if the player hand has a point total of 6 or 7, the bank hand draws a third card on a point total of 0, 1, 2, 3, 4 or 5 and the bank hand stands on a point total of 6 or 7.

Rule #3: If the player hand draws a third card, the bank hand must draw or stand as described in Table 1.

TABLE 1

| Bank hand two card point total | Bank hand draws when the player's hand third card is: | Bank hand stands when the player's hand third card is: |
|---|---|---|
| 0, 1 or 2 | Bank always draws | — |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | — | Bank always stands |

All third card draw determinations are automatically made by the caller who is skilled in the game of baccarat. When the rules of baccarat require a third card for the player hand, the caller will request a card for the player hand. After the player hand is completed, the bank hand is completed in the same fashion. The caller then declares which hand has the highest point total and declares that hand the winner (or the caller declares a tie hand as the case may be).

In conventional baccarat the bettor who acts as the dealer continues to deal the cards until the player hand wins. As soon as the player hand wins, it is customary to pass the shoe counterclockwise around the baccarat table to the next bettor so that each bettor has the opportunity to deal the cards. Any bettor may decline to deal the cards. The fact that one of the bettors is physically dealing the cards has no affect on the outcome of the game because the rules for drawing and standing do not allow any discretion on the part of the players.

The players can play the game according to conventional baccarat rules, which may vary from place to place. In one embodiment, the baccarat game is played according to the U.S. rules as used in Las Vegas. In another embodiment, the baccarat game is played according to the baccarat rules promulgated by the government of Macau Special Administration Region.

In some embodiments, there is a maximum limit on the total bet can be made through a single betting terminal for the live baccarat game. In one embodiment, the maximum bet can be made through one terminal for live baccarat is, for example, HK$20,000.

Jackpot

The method and system described herein provide a method for jackpot betting, Paradise Jackpot™. The players of the live baccarat game can make a separate bet for jackpot. The jackpot bet can be placed with a bet for live baccarat or without a bet for the same live baccarat.

In some embodiments, the outcome of the jackpot betting is determined by the combination of cards that includes zero-point cards. The combination includes at least one zero-point cards, which are 10, J, Q and K. In one embodiment, the rules for playing Paradise Jackpot™. are described below:

(1) The gaming system provides a jackpot. Players who wish to bet on the Paradise Jackpot can place a separate bet, e.g. HKD 20 per game in minimum, which will be referred to as bet unit. The maximum number of bet units will not be restricted.

(2) Players can bet in Paradise Jackpot without placing bet in the same live baccarat game. Each player can place more than one bet unit in one game. When the Paradise Jackpot is won, the payout for each bet unit will be equal to the money in the Paradise Jackpot™ pool divided by the total number of bet unit.

(3) If the first 5 cards drawn in one baccarat game resulting in A, K, Q, J, 10 in spade, regardless of the sequence, then 100% of the Paradise Jackpot™ is won.

(4) If the first 5 cards drawn in one baccarat game resulting in K, Q, J, 10 in spade and A in either heart, club or diamond, regardless of the sequence, then 10% of the Paradise Jackpot™ is won.

There may be more than one live baccarat game going on simultaneously in different casinos in Macau. In some embodiments, all Paradise Jackpot™ bets from different live baccarat tables will contribute to one grand Paradise Jackpot™ pool. If the Paradise Jackpot is won in any one live baccarat table, all players who place Paradise Jackpot bets, regardless of the live baccarat table they bet, will share the grand Paradise Jackpot™ pool according to the bet units that each player placed in the jackpot betting.

Paradise Jackpot™ can be played with bets from players as the sole source of the jackpot pool or with bets and an initial contribution from the banker. The term "banker" generally refers to the owner of a gaming establishment operating the live baccarat defined herein or one who operates the live baccarat game. In one embodiment, the banker contributes a sum of money as the initial Paradise Jackpot (e.g., HKD 50,000). A certain percentage, e.g., 55%, of the Paradise Jackpot bets from the players will be contributed towards the Paradise Jackpot pool, a certain percentage (e.g., 40%) of the bets will be collected by the banker as profit, and the remaining portion (e.g., 5%) of the bets will be accumulated as the seed for the next game.

An embodiment of the general gaming method described herein is shown in the flowchart in FIG. 1. The flowchart shows the steps in playing the live baccarat games described herein. Step 110 shows the baccarat is ready to start a game. In step 120, the dealer presses the Start button on the baccarat machine to count-down the time for accepting bets. In step 130, the betting terminal, BU, accepts bets. Step 140 shows that the time for accepting bets is over and the dealer press the Cut-off button on the machine. In step 150, the server, which is also referred to as betting computation and track record central processing unit (BCPU), receives all bets from betting terminals. The dealer then obtains and displays cards in step 160. In step 170, the baccarat game gives results and the dealer presses approve button, approving the card dealing made, game results and payouts. The server, BCPU, then computes and distributes wins in step 180. The live baccarat game is over, as shown in step 190, and the machine is ready for next round of baccarat game that begins with step 110.

In another aspect of the present invention, it is provided a software program or a set of software programs that allows a user or player to any or all of the various aspects of playing the live baccarat Paradise Jackpot™ described herein. The software program can be written by one of ordinary skill in the art.

Gaming System

Figure 2:
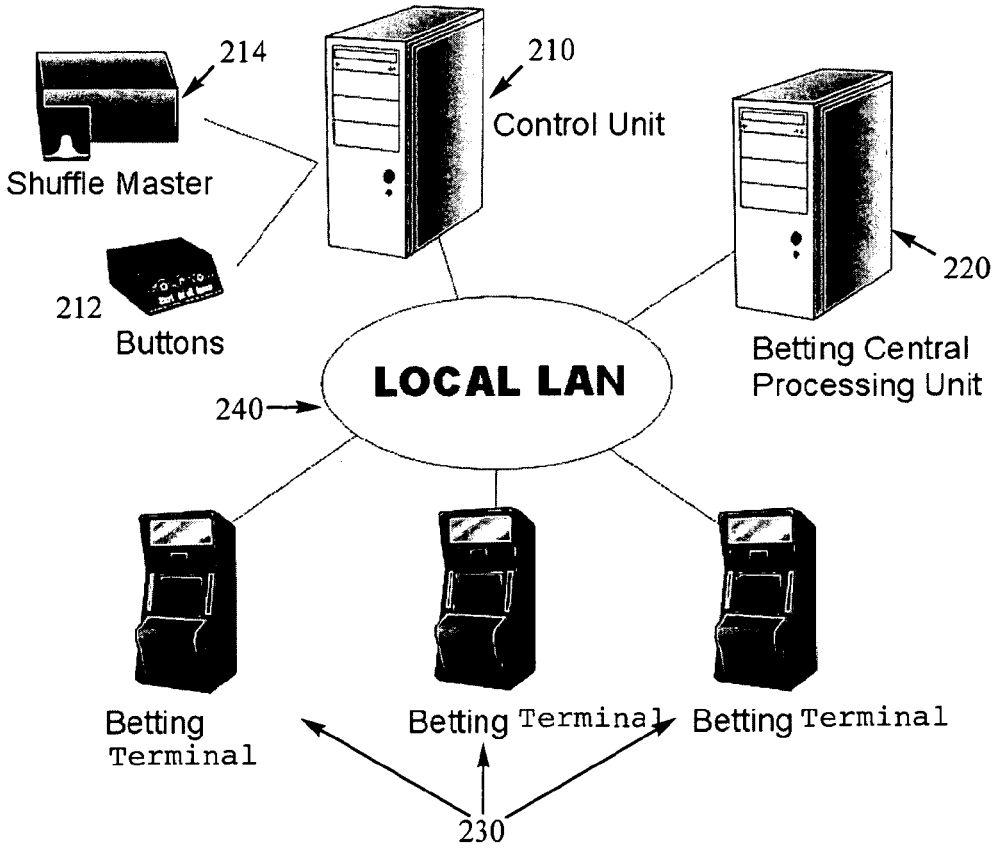
FIG. 2 shows a system embodying live baccarat jackpot of the present invention.
Figure 4A:
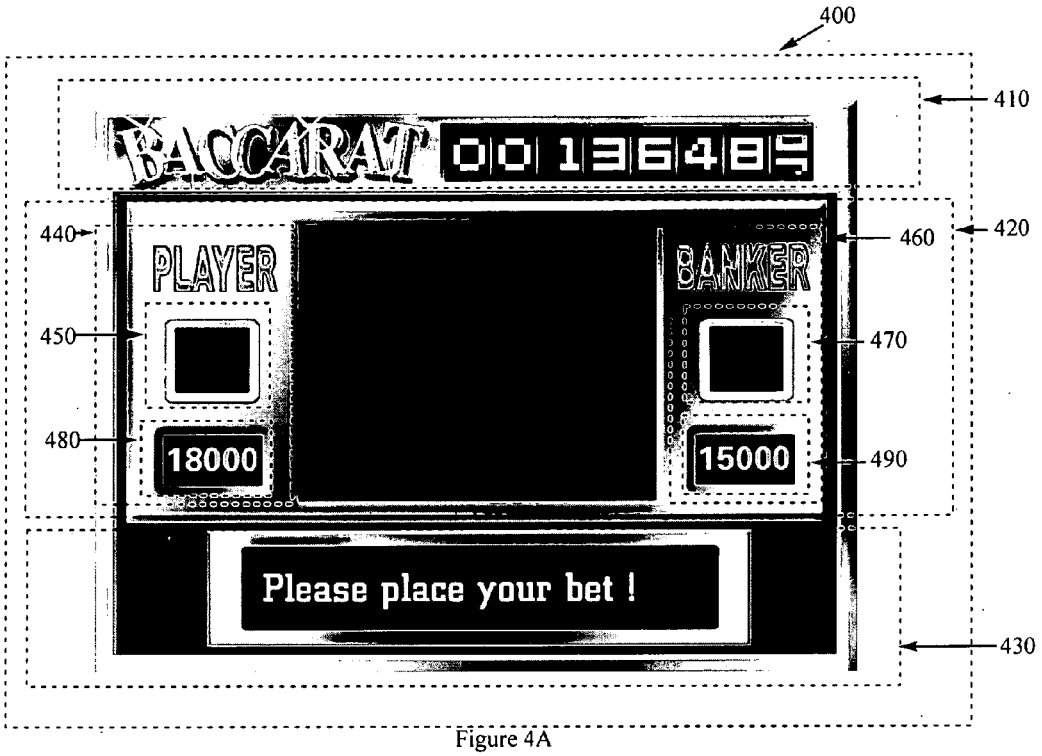
Figure 4B:
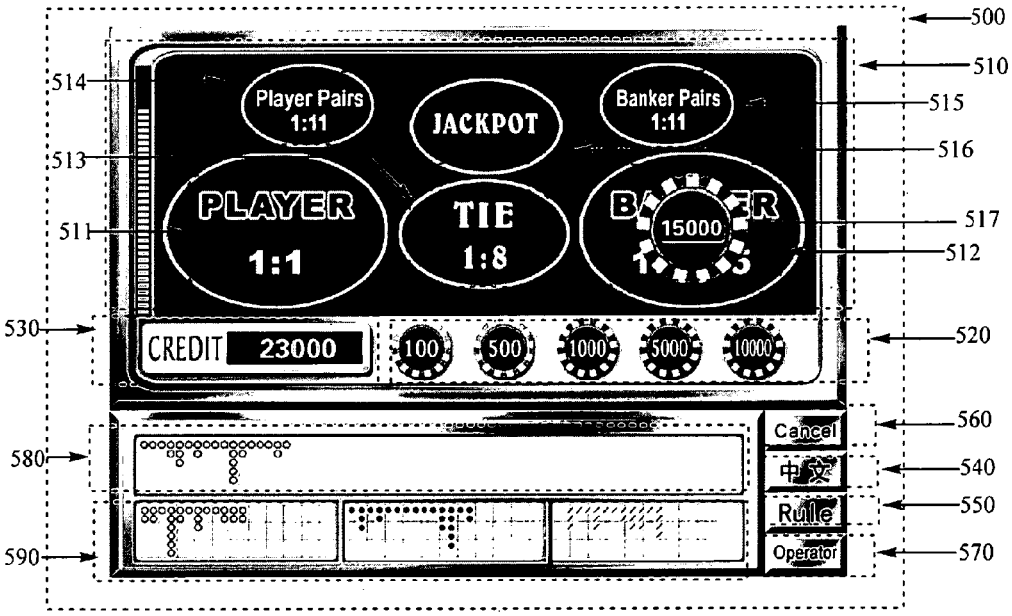

One aspect of the present invention provides a baccarat gaming system that allows one to play the live baccarat jackpot described herein. One embodiment of the present invention is shown in FIG. 2. Referring FIG. 2, the baccarat gaming system includes three members: (1) the control unit for automatic shuffle mechanism (CU) (210), (2) betting computation and tract record central processing unit (BCPU) (220), and (3) betting terminal for players (BT) (230) (FIG. 2). The control unit 210 may further contain control buttons (212) that allows the dealer to control the shuffling mechanism, which can be manual or automatic, and/or a shuffle master (214), which can be manual or automatic, for shuffling the cards. The CU 210 can include any or all of the components which may include control buttons that allow input from dealer and/or capable of (1) receiving the shuffle mechanism input, (2) sending visual output to a screen, and/or (3) sending card results in the player hand and/or bank hand to BCPU 220. The BCPU 220 has components or members capable of performing any or all of (1) receiving betting from BT (230), (2) receiving card results from CU 210, (3) sending betting results to BT 230, and/or (4) sending credit to BT 230.

The betting terminal for players, BT 230, has components or members capable of performing any or all of (1) sending betting to BCPU 220, (2) receiving betting results from BCPU 220, and/or (3) receiving credit from BCPU 220. Note, the baccarat gaming system can have a number of betting terminals, depending on the need of a gaming establishment. For example, if desirable, the baccarat gaming system can have 1, 2, 3, 4, 5, 6, 7, 8, 9, or 10, up to, e.g., 50 or 250 BTs. CU 210, BCPU 220, and BT 230 can be linked together via a local area network (LAN) (240) to form a baccarat gaming network between one, two, three or several gaming establishments.

The live baccarat game can have different variations. For example, the game can be played separately as a single live baccarat game. In some embodiments, the individual baccarat games can be linked together. The individual games can all be played in a casino or gaming establishment or in several casino or gaming establishments.

A layout for the live baccarat game described herein is shown in FIGS. 3A and 3B. FIGS. 3A and 3B show the overall layout of the betting terminal which has two screens, the upper screen (400) and the lower screen (500), shown in detail in FIGS. 3A and 3B. Referring to FIG. 3A, upper screen 400 includes an upper part (410) for displaying the result, score and latest jackpot amount, the center part (420) for displaying a live video of the gambling table, and a messenger screen (430) for displaying messages. In one embodiment, the jackpot amount digits can be programmed to be in rolling motion to reflect the increasing jackpot pool. The center part of the upper screen has a section designated as Player (440), which has a small screen (450), and another section designated as Banker (460), which also has a small screen (470). The small screens 450 and 470 are for display of card values of the player hand and the bank hand respectively. The current amount of total wagers on Player (player hand) and Banker (bank hand) in a live baccarat game are shown in small screens 480 and 490 below small screens 450 and 470, respectively.

Referring to FIG. 3B, the lower screen 500 is an operating touch screen for betting, which includes bet-option buttons (510), bet-amount buttons (520), and credit window (530). The bet-option buttons 510 include the various betting selections described above, e.g., betting for player hand (511) win with a payoff rate of 1:1, for the bank hand (512) win with a payoff rate of 1:0.95, for tie (513) with a payoff rate of 1:8, for Player Pairs (514) with a payoff rate of 1:11, for banker pairs (515) with a payoff rate of 1:11, and for Jackpot bet (516), the rules of which are described above. Box 517 shows the pops up when bets are placed on a particular bet option. The number inside Box 517 corresponds to the amount placed on a particular bet option. The bet-amount buttons 520 as shown in the layout, 100, 500, 1000, 5000, 10000, provide the players the convenience of adding up betting amounts in a fast manner. To illustrate, for a bet of 10,000 USD or HKD, the player can simply press the "1000" button ten times to reach the desired betting amount. Note, the bet-amount buttons 520 shown are illustrative and non-exclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance.

Still referring to FIG. 3B, the lower screen 500 further includes language selection button (540), which can switch the operation language of the baccarat game between, e.g., English, Portuguese, Italian, French, Spanish, Russian, German, Arabic, Japanese, and Korean, etc, Rule selection button (550), which prompts the display of rules for live baccarat and Paradise Jackpot, Cancel button (560), which allows the bettor to cancel all bets made before the cards are dealt, Operator button (570), which allows the bettor to call for assistance from the casino staff when there is machine failure or the bettor wishes to exit from the game, and Results Bars (580, 590) which display the results for previous live baccarat games. Once results of a game are confirmed, the losing bet shown in the bet option buttons (510) in the center of lower screen will disappear while the winning bet in the bet option buttons (510) in the lower screen will flash with the total amount won.

In some other embodiments, the baccarat jackpot game can be played in an entertainment setting, e.g., in the form of game device such as laptop or desktop computers.

In a further embodiment, the baccarat jackpot game can be played in a non-baccarat game, e.g., blackjack, or showhand. The rules of these games other than baccarat games are known to one in the art.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

The invention claimed is:

1. A method for conducting a baccarat jackpot, based on results of one or more live baccarat games, on a baccarat gaming system, the baccarat gaming system having a control unit (CU), a betting computation and track record central processing unit (BCPU), and a plurality of betting terminals (BTs), the CU, the BCPU and the BTs being linked via a network, the CU including control buttons for allowing a dealer to control a shuffle mechanism for shuffling cards, to send card results in a player hand or a bank hand to the BCPU, and to send visual outputs to screens associated with the baccarat gaming system, the BCPU including components for receiving bets from the BTs, receiving the card results from the CU, sending betting results to the BTs, and sending credit to the BTs, the method comprising:

receiving first bets pertaining to the live baccarat games from first players playing at the BTs, the one or more live baccarat games being played according to conventional baccarat rules including a third card draw;

receiving second bets pertaining to the baccarat jackpot from second players playing at the BTs, the second bets including one or more bet units on one or more of the live baccarat games, each bet unit being a minimum permitted for the second bets;

determining betting results of the baccarat jackpot for the second players placing the second bets according to the following rules:

determining 100% of a baccarat jackpot pool as won if the first 5 cards drawn result in A, K, Q, J, and 10 in spade, regardless of the sequence, and determining 10% of the baccarat jackpot pool as won if the first 5 cards drawn result in K, Q, J, and 10 in spade and A in either heart, club or diamond, regardless of the sequence; and calculating a payout for each bet unit as a percentage of the baccarat jackpot pool, wherein the first players and the second players are selected from two distinct groups, two overlapping groups, or one single player.

2. The method of claim 1, wherein the BTs are distributed in one or more casinos for receiving bets from players, including the first players and the second players, and communicating the betting results to players of the baccarat gaming system.

3. The method of claim 2, wherein the baccarat gaming system is in communication with a plurality of live baccarat tables in one or more casinos, and wherein the live baccarat games include games being played at live baccarat tables by third players different from the first players and the second players.

4. The method of claim 3, further comprising:

conducting each of the live baccarat games, wherein the conducting comprises:

receiving a start command from a dealer pressing a start button on the CU to begin a countdown period for accepting the first bets from the first players, the first bets being placed on one of the live baccarat games being played at one or more of the other BTs or one or more of the live baccarat tables, in communication with the BTs, in one or more casinos;

collecting the first bets, received during the countdown period, at the BCPU at termination of the countdown period;

displaying cards dealt to the player hand and the bank hand at each of the live baccarat games responsive to a command from the dealer; and displaying the betting results and betting payouts at each of the BTs, responsive to an approval by the dealer.

5. The method of claim 1, wherein the baccarat jackpot pool consists of the second bets placed on all of the live baccarat games, and wherein the payout for each bet unit is calculated as a percentage of the baccarat jackpot pool divided by the total number of the bet units placed by all the second players.

6. The method of claim 1, wherein a first portion of the second bets is contributed towards the baccarat jackpot pool, a second portion of the second bets is collected by a banker as profit, and a remaining portion of the second bets is accumulated as a seed for a next game.

7. The method of claim 1, wherein 55% of the second bets is contributed towards the baccarat jackpot pool, 40% of the second bets is collected by a banker as profit, and 5% of the second bets is accumulated as a seed for a next game.

8. The method of claim 1, wherein the BTs are selected from game devices, laptops or desktop computers.

9. The method of claim 1, wherein the betting results of the baccarat jackpot for the second players placing the second bets on a particular one of the live baccarat games is determined according to following rules:

determining 100% of a baccarat jackpot pool as won if first 5 cards drawn in the particular live baccarat game result in A, K, Q, J, and 10 in spade, regardless of the sequence, and determining 10% of the baccarat jackpot pool as won if the first 5 cards drawn in the particular live baccarat game result in K, Q, J, and 10 in spade and A in either heart, club or diamond, regardless of the sequence.

10. A system for conducting a baccarat jackpot, based on results of one or more live baccarat games, the system comprising:

a control unit (CU);

a betting computation and track record central processing unit (BCPU); and a plurality of betting terminals (BTs), the CU, the BCPU and the BTs being linked via a network, wherein the CU includes control buttons for allowing a dealer to control a shuffle mechanism for shuffling cards, to send card results in a player hand or a bank hand to the BCPU, and to send visual outputs to screens associated with the system, wherein the BCPU includes components for receiving bets from the BTs, receiving the card results from the CU, sending betting results to the BTs, and sending credit to the BTs, wherein each BT is adapted for receiving first bets pertaining to the live baccarat games from first players playing at the BT, the live baccarat games being played according to conventional baccarat rules including a third card dealing, wherein each BT is adapted for receiving second bets pertaining to the baccarat jackpot from second players playing at the BTs, the second bets including one or more bet units on one or more of the live baccarat games; and wherein betting results of the baccarat jackpot are determined for the second players placing the second bets according to the following rules:

determining 100% of a baccarat jackpot pool as won if the first 5 cards drawn result in A, K, Q, J, and 10 in spade, regardless of the sequence, and determining 10% of the baccarat jackpot pool as won if the first 5 cards drawn result in K, Q, J, and 10 in spade and A in either heart, club or diamond, regardless of the sequence.

11. The system of claim 10, wherein the BTs are distributed in one or more casinos for receiving the bets from players, including the first players or the second players, and communicating the betting results to the players of the system.

12. The system of claim 11, further comprising:

a plurality of live baccarat tables in one or more casinos in communication with the BTs, wherein the live baccarat games include games being played at the live baccarat tables by third players different from the first players and the second players.

13. The system of claim 12:

wherein the CU includes start buttons for receiving a start command from the dealer pressing a start button to begin a countdown period for accepting the first bets from the first players, the first bets being placed on one of the live baccarat games being played at one or more of the BTs or one or more of the live baccarat tables, wherein the BCPU includes a processor for collecting the first bets at termination of the countdown period, and wherein each of the BTs includes a first display portion for displaying cards dealt to the player hand and the bank hand corresponding to each of the live baccarat games responsive to a command from the dealer, and a second display portion for displaying the betting results and betting payouts, responsive to an approval by the dealer.

14. The system of claim 12, wherein each of the BTs includes:

an upper screen including an upper part for displaying the betting results, score and latest baccarat jackpot pool, a center part for displaying a live video of the live baccarat tables, and a messenger screen for displaying messages; and a lower screen being an operating touch screen for receiving the bets, the lower screen including bet-option buttons, bet-amount buttons, and credit window.

15. The system of claim 14, wherein digits showing an amount of the baccarat jackpot pool are shown in rolling motion on the upper part of the upper screen to reflect an increasing baccarat jackpot pool, wherein the center part of the upper screen has a section designated as player and another section designated as banker for displaying card values of the player hand and the bank hand respectively, and wherein a current amount of total bets on the player hand and the bank hand in the live baccarat game are shown on the upper screen, below the player hand and the bank hand respectively.

16. The system of claim 14, wherein the lower screen includes:

bet-option buttons comprising selections of the first bets including betting for the player hand to win with a payoff rate of 1:1, betting for the bank hand to win with a payoff rate of 1:0.95, betting for a tie to win with a payoff rate of 1:8, betting for player pairs to win with a payoff rate of 1:11, and betting for banker pairs to win with a payoff rate of 1:11, and the second bets including betting for the baccarat Jackpot;

a pop-up box popping up when bets are placed on a particular bet option, a number inside each pop-up box corresponding to a betting amount placed on a particular bet option;

bet-amount buttons for adding up the betting amounts; and a credit window for showing remaining balance of credit of a player.

17. The system of claim 16, wherein once results of the first bets or the second bets are confirmed, the bet-option buttons show a losing bet disappearing while a winning bet flashes with the total amount won.

18. The system of claim 16, wherein the lower screen further includes:

a language selection button for switching operational language of the BTs between several pre-determined languages;

a rule selection button for prompting a display of rules for the live baccarat game and the baccarat jackpot;

a cancel button for allowing players to cancel all bets made before cards are dealt;

an operator button for allowing players to call for assistance from casino staff; and results bars for displaying results of previous live baccarat games.

19. The system of claim 10, wherein the BCPU apportions a first portion of the second bets towards a baccarat jackpot pool, a second portion of the second bets as profit, and a remaining portion of the second bets as a seed for a next game.

20. The system of claim 10, wherein the BTs are selected from game devices, laptops or desktop computers.

* * * * *